US009920965B2

(12) United States Patent
Joo et al.

(10) Patent No.: US 9,920,965 B2
(45) Date of Patent: Mar. 20, 2018

(54) AIR CONDITIONER WITH OIL SEPARATORS AND METHOD FOR CONTROLLING THE SAME

(71) Applicant: LG ELECTRONICS INC., Seoul (KR)

(72) Inventors: Jinyoung Joo, Seoul (KR); Seokhoon Jang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 624 days.

(21) Appl. No.: 14/524,945

(22) Filed: Oct. 27, 2014

(65) Prior Publication Data

US 2015/0114013 A1 Apr. 30, 2015

(30) Foreign Application Priority Data

Oct. 30, 2013 (KR) ..... 10-2013-0130610

(51) Int. Cl.
*F25B 43/02* (2006.01)
*F25B 49/02* (2006.01)
(Continued)

(52) U.S. Cl.
CPC ..... *F25B 43/02* (2013.01); *F25B 31/004* (2013.01); *F25B 40/02* (2013.01); *F25B 41/003* (2013.01);
(Continued)

(58) Field of Classification Search
CPC .. F25B 31/004; F25B 43/02; F25B 2400/075; F25B 2400/0751; F25B 2500/16; F25B 2700/03
See application file for complete search history.

(56) References Cited

U.S. PATENT DOCUMENTS 5,369,958 A * 12/1994 Kasai ..... F24F 3/065 62/158
2008/0087028 A1* 4/2008 Kim ..... F25B 31/004 62/84
(Continued)

FOREIGN PATENT DOCUMENTS

JP 2001-324236 11/2001
JP 2001-349625 12/2001
(Continued)

OTHER PUBLICATIONS

"Connected." Merriam-Webster, Merriam-Webster, www.merriam-webster.com/dictionary/connected.*
European Search Report dated Mar. 31, 2015.

*Primary Examiner* — Jonathan Bradford
(74) *Attorney, Agent, or Firm* — KED & Associates, LLP

(57) ABSTRACT

An air conditioner and a method for controlling and air conditioner are provided. The air conditioner may include at least one compressor, a main suction passage to guide a refrigerant into the at least one compressor, at least one oil separator connected to the at least one compressor, that separates oil from the refrigerant discharged from the at least one compressor, at least one oil level sensor disposed in the at least one compressor to detect whether the at least one compressor lacks oil, a return passage to collect the oil separated from the at least one oil separator into the at least one compressor, a distribution return passage branched from the at least one return passage and connected to the main suction passage, and a valve disposed in each of the at least one return passage and the distribution return passage.

13 Claims, 9 Drawing Sheets

(51) Int. Cl.
*F25B 31/00* (2006.01)
*F25B 40/02* (2006.01)
*F25B 41/00* (2006.01)

(52) U.S. Cl.
CPC ..... *F25B 49/02* (2013.01); *F25B 2400/061* (2013.01); *F25B 2400/23* (2013.01); *F25B 2500/16* (2013.01); *F25B 2600/2515* (2013.01); *F25B 2700/03* (2013.01)

(56) References Cited

U.S. PATENT DOCUMENTS

2008/0209924 A1 9/2008 Yoon et al.
2009/0107170 A1* 4/2009 Yoon ..... F25B 31/004 62/468

FOREIGN PATENT DOCUMENTS

JP 2001-349644 12/2001
WO WO 2008044807 A2 * 4/2008 ..... F25B 31/004

* cited by examiner

AIR CONDITIONER WITH OIL SEPARATORS AND METHOD FOR CONTROLLING THE SAME

CROSS-REFERENCE TO RELATED APPLICATION(S)

The present application claims priority under 35 U.S.C. 119 and 35 U.S.C. 365 to Korean Patent Application No. 10-2013-0130610, filed in Korea on Oct. 30, 2013, which is hereby incorporated by reference in its entirety.

BACKGROUND

1. Field

An air conditioner and a method for controlling an air conditioner are disclosed herein.

2. Background

Air conditioners are home appliances that maintain indoor air in a most proper state according to a use and purpose thereof. In general, such an air conditioner may include a compressor, a condenser, an expansion device, and an evaporator. Thus, the air conditioner has a refrigerant cycle in which compression, condensation, expansion, and evaporation processes of a refrigerant are performed to cool or heat a predetermined space.

The predetermined space may be a place at or in which the air conditioner is used. For example, when the air conditioner is disposed in a home or office, the predetermined space may be an indoor space of a house or building. On the other hand, when the air conditioner is disposed in a vehicle, the predetermined space may be a riding space in which a person or user rides.

When the air conditioner performs a cooling operation, an outdoor heat-exchanger provided in an outdoor unit or device may serve as a condenser, and an indoor heat-exchanger provided in an indoor unit or device may serve as an evaporator. On the other hand, when the air conditioner performs a heating operation, the indoor heat-exchanger may serve as a condenser, and the outdoor heat-exchanger may serve as an evaporator.

An inner temperature of the compressor may increase to a relatively high temperature while the compressor compresses the refrigerant. A predetermined amount of oil to provide lubrication and cooling functions may be included in the compressor. However, as described above, when the inner temperature of the compressor increases to the relatively high temperature, the oil in the compressor may be included in the refrigerant being discharged. Thus, an amount of the oil in the compressor may be reduced or decline.

Therefore, an oil separator may be connected to a discharge tube of the compressor to separate the oil included in the discharged refrigerant and re-collect the separated oil into the compressor. When a plurality of compressors is provided, the oil separator may be connected to an outlet-side of each of the compressors.

However, when the oil separator is connected to the outlet-side of each of the plurality of compressors, an amount of oil received in each of the plurality of compressors may not be uniform. That is, when the plurality of compressors has different capacities from each other, and thus, discharge different amounts of refrigerant, amounts of oil being discharged may be different from each other. Thus, amounts of the oil in the plurality of compressors may be imbalanced or different from each other. Also, when a compressor operates in a state in which an amount of oil therein is non-uniformly maintained, the compressor may break, and thus, a cooling/heating system employing the compressor may operate abnormally.

FIG. 1 is a schematic diagram of a plurality of compressors in a related art air conditioner. FIG. 2 is flow chart of a method for controlling oil balancing in the related art air conditioner of FIG. 1.

Referring to FIGS. 1 and 2, the related art air conditioner includes a first compressor 11 and a second compressor 12. A first inflow tube 13 to guide introduction of a refrigerant or oil into the first compressor 11 and a first discharge tube 14 to guide the refrigerant or oil discharged from the first compressor 11 may be connected to the first compressor 11. A second inflow tube 15 to guide introduction of the refrigerant or oil into the second compressor 12 and a second discharge tube 16 to guide the refrigerant or oil discharged from the second compressor 12 may be connected to the second compressor 12.

The first and second inflow tubes 13 and 15 are branched at a branch point 22, and the branched first and second inflow tubes 13 and 15 are, respectively, connected to the compressors 11 and 12. Also, the first and second discharge tubes 14 and 16 are combined with each other at a combination point 21.

A first oil level sensor 17 and a second oil level sensor 18 may be disposed in or at the first and second compressors 11 and 12, respectively. Each of the oil level sensors 17 and 18 may detect an amount of oil at a predetermined position in the respective compressor.

Referring to FIG. 2, when the first and second compressors 11 and 12 operate at a set or predetermined drive frequency, a predetermined amount of oil may be introduced into the first and second compressors 11 and 12 in accordance with the corresponding drive frequency, in step S11. A control number N is initialized to zero, in step S12. In step S12, the control number N may be understood as a number of control operations performed to reduce the drive frequency of the first compressor 11.

In steps S13 and S14, the first oil level sensor 17 detects an amount of oil contained in the first compressor 11 and determines whether the detected oil amount is less than a reference amount. When it is determined that the detected oil amount is less than the reference amount, it may be determined whether the controlled number N has reached a first set or predetermined number M, in step S15. When N<M, the first compressor 11 may perform a control to reduce the drive frequency and then operate for a preset or predetermined time, in step S16. Also, the control number N is increased by 1 (N=N+1), in step S17. Then, the process may return to step S13. Steps S13 to S17 may be repeated.

During the process, in steps S16, when it is determined that N=M, the first and second compressors 11 and 12 operate at a normal frequency. That is, in the related art, when an amount of oil contained in one compressor of the plurality of compressors is less than the reference amount, the corresponding compressor is reduced in drive frequency to reduce a discharge amount of refrigerant, and then, a relatively large amount of refrigerant is discharged from the rest of the compressors to adjust the amount of oil contained in the refrigerant.

Therefore, as it takes a lot of time to collect the oil, oil balancing may not be quickly achieved.

BRIEF DESCRIPTION OF THE DRAWINGS

Embodiments will be described in detail with reference to the following drawings in which like reference numerals refer to like elements, and wherein.

DETAILED DESCRIPTION

Figure 1:
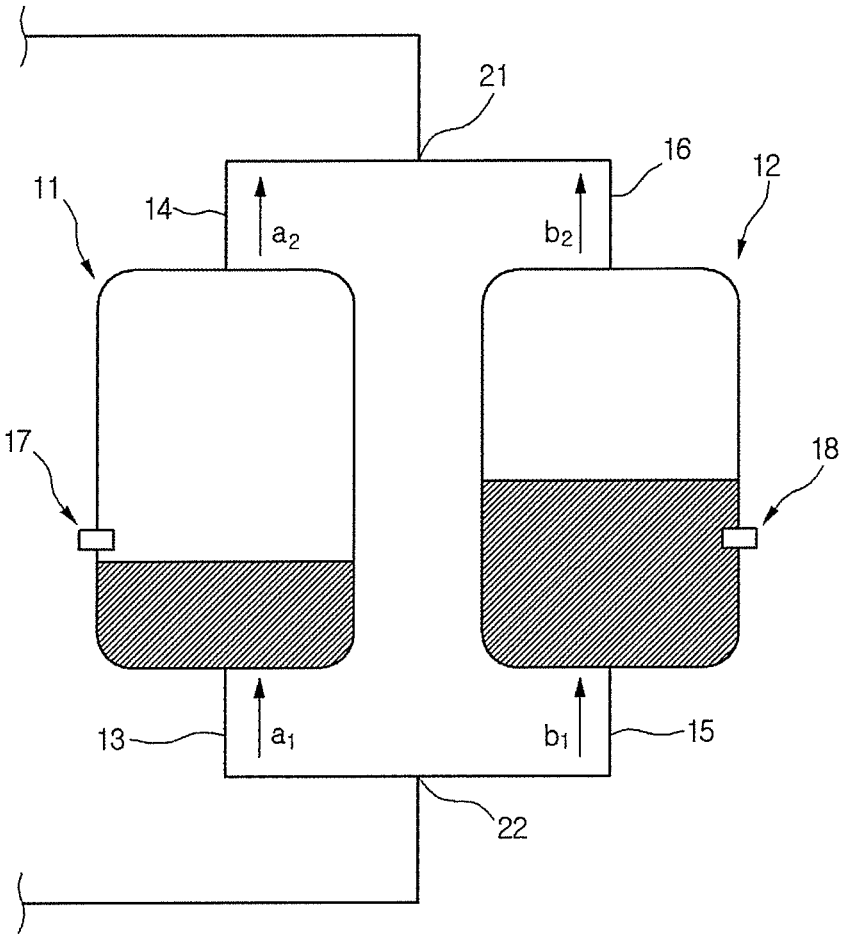
FIG.1 Related Art
FIG. 1 is a schematic diagram of a plurality of compressors in a related art air conditioner.
Figure 2:
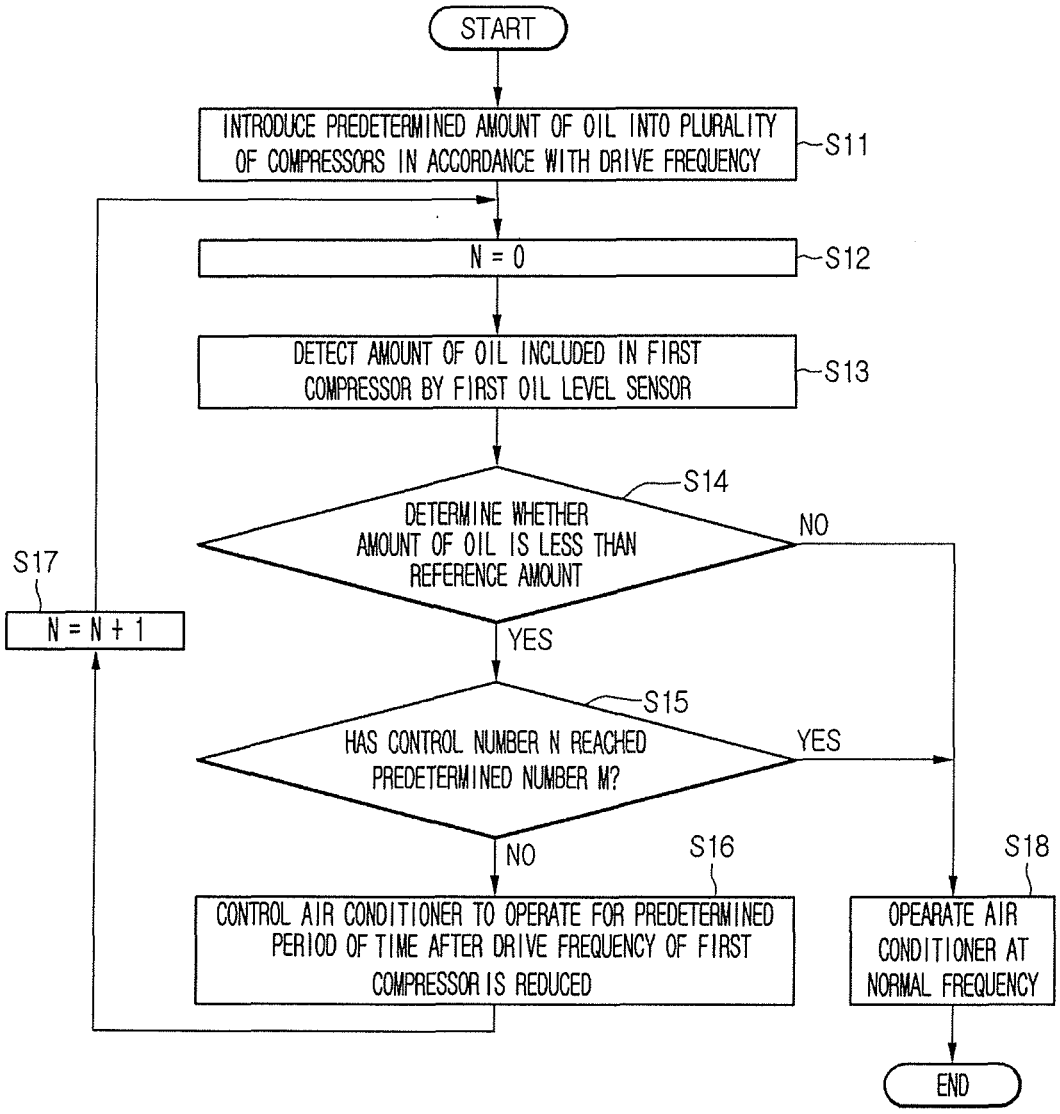
FIG.2 Related Art
FIG. 2 is a flow chart of a method for controlling oil balancing in the related art air conditioner of FIG. 1.

Reference will now be made in detail to embodiments, examples of which are illustrated in the accompanying drawings. The embodiments may, however, be embodied in many different forms and should not be construed as being limited to the embodiments set forth herein; rather, alternate embodiments included in other retrogressive inventions or falling within the spirit and scope will fully convey the concept of the invention to those skilled in the art. Where possible, like reference numerals have been used to indicate like elements, and repetitive disclosure has been omitted.

Figure 3:
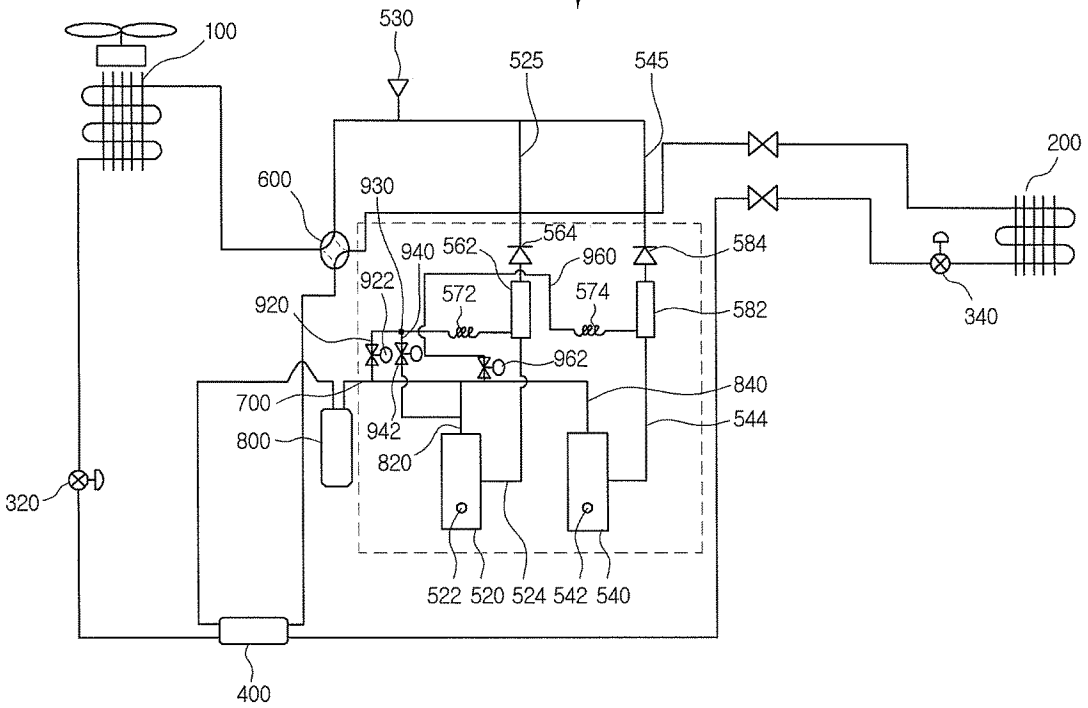
FIG. 3 is a schematic diagram of an air conditioner according to an embodiment.

FIG. 3 is a schematic diagram of an air conditioner according to an embodiment. Referring to FIG. 3, an air conditioner 50 according to an embodiment may include an indoor unit or device disposed in an indoor space and an outdoor unit or device disposed in an outdoor space. The outdoor device and the indoor device may include an outdoor heat exchanger 100 and an indoor heat exchanger 200 to perform heat-exchange, respectively.

The outdoor device may include a plurality of compressors 520 and 540, and a plurality of oil separators 562 and 582 disposed, respectively, at outlet-sides of the plurality of compressors 520 and 540 to separate oil from a refrigerant discharged from each of the compressors 520 and 540. The plurality of compressors 520 and 540 may include a first compressor 520 and a second compressor 540. The first and second compressors 520 and 540 may be parallelly connected to each other.

For example, the first compressor 520 may correspond to a main compressor, and the second compressor 540 may correspond to a sub compressor. Thus, according to performance or load of a system, the first compressor 520 may firstly or primarily operate, and then the second compressor 540 may additionally operate when the first compressor 520 does not have sufficient capacity. An amount of refrigerant discharged from the first compressor 520 may be greater than an amount of refrigerant discharged from the second compressor 540.

The plurality of oil separators 562 and 582 may include a first oil separator 562 disposed at an outlet-side of the first compressor 520 and a second oil separator 582 disposed at the outlet-side of the second compressor 540. The air conditioner 50 may further include a first discharge passage 524 that extends from the outlet-side of the first compressor 520 to the first oil separator 562, and a second discharge passage 544 that extends from the outlet-side of the second compressor 540 to the second oil separator 582.

The air conditioner 50 may further include a first refrigerant discharge passage 525 disposed at an outlet-side of the first oil separator 562, and a second refrigerant discharge passage 545 disposed at an outlet-side of the second oil separator 582. The first refrigerant discharge passage 525 may be combined with the second refrigerant discharge passage 545. The combined discharge passage may extend to a flow switch 600.

A high pressure sensor 530 to detect a high pressure of the refrigerant may be disposed in the combined passage. The refrigerant passing through the high pressure sensor 530 may be introduced into the flow switch 600, and then, may be guided from the flow switch 600 toward the outdoor heat exchanger 100 or the indoor device.

A first check valve 564 may be disposed in the first refrigerant discharge passage 525 to prevent the refrigerant from being re-introduced into the first oil separator 562. A second check valve 584 may be disposed in the second refrigerant discharge passage 545 to prevent the refrigerant from being re-introduced into the second oil separator 582.

A main expansion valve 320 may be disposed at the outlet-side of the outdoor heat exchanger 100 during a cooling operation. The main expansion device 320 may include an electric expansion valve (EEV). When the cooling operation is performed, the main expansion valve 320 may be fully opened, and thus, may not perform decompression of the refrigerant.

The air conditioner 50 may further include an overcooling heat exchanger 400, into which the refrigerant passing through the outdoor heat exchanger 100 may be introduced, and a gas-liquid separator 800 to separate a gaseous refrigerant from the refrigerant before the refrigerant is introduced into the first and second compressors 520 and 540.

The gaseous refrigerant separated by the gas-liquid separator 800 may be transferred into the first and second compressors 520 and 540 through a main suction passage 700. The main suction passage 700 may extend from an outlet-side of the gas-liquid separator 800 toward the first and second compressors 520 and 540.

The main suction passage 700 may be branched into a first suction passage 820, and a second suction passage 840. The first suction passage 820 may extend to the first compressor 520, and the second suction passage 840 may extend to the second compressor 540. That is, the first and second suction passages 820 and 840 may extend from the main suction passage 700 to the first and second compressors 520 and 540, respectively.

The air conditioner 50 may further include return passages 920, 940, and 960 to collect the oil from the first and second oil separators 562 and 582 into the first and second compressors 520 and 540. The return passages 920, 940, and 960 may include a first return passage 940 that extends from the first oil separator 562 to the first suction passage 820, a second return passage 960 that extends from the second oil separator 582 to the second suction passage 840, and a distribution return passage 920 that extends from the first return passage 940 to the main suction passage 700.

In detail, the first return passage 940 may have a first end connected to the first oil separator 562, and a second end connected to the first suction passage 820. The second return passage 960 may have a first end connected to the second oil separator 582, and a second end connected to the second suction passage 840.

The distribution return passage 920 may have a first end connected to a branch point 930 of the first return passage 940, and a second end connected to the main suction passage 700. In other words, the distribution return passage 920 may be branched from the first return passage 940 and connected to the main suction passage 700. A portion of the first return passage 940 where the distribution return passage 920 may be branched may be referred to as the branch point 930.

The first and second return passages 940 and 960 may further include a first capillary tube 572 and a second capillary tube 574, respectively, to adjust an amount of oil to be collected.

Valves 922, 942, and 962 to control collection of the oil may be disposed in the return passages 920, 940, and 960, respectively. In detail, a first valve 922 may be disposed in the distribution return passage 920, and a second valve 942 may be disposed in the first return passage 940. A third valve 962 may be disposed in the second return passage 960. For example, each of the first to third valves 922, 942, and 962 may include a solenoid valve capable of controlling an on-off operation thereof. As another example, each of the first to third valves 922, 942, and 962 may include an electronic expansion valve capable of adjusting an opening degree thereof.

Each of the first to third valves 922, 942, and 962 may be controlled to adjust an amount of oil collected through each of the return passages 920, 940, and 960. When the second valve 942 is opened, the oil in the first oil separator 562 may be introduced into the first suction passage 820 through the first return passage 940 and the second valve 942, and then, may be collected into the first compressor 520. Thus, when the first compressor 520 lacks oil, the oil may be easily collected from the first oil separator 562.

When the third valve 962 is opened, the oil in the second oil separator 582 may be introduced into the second suction passage 840 through the second return passage 960 and the third valve 962, and then, may be collected into the second compressor 540. Thus, when the second compressor 540 lacks oil, the oil may be easily collected from the second oil separator 582.

The first compressor 520 may function as the main compressor. The first compressor 520 may firstly or primarily operate before the second compressor 540 operates according to a performance of the system, and thus, an amount of oil discharged from the first compressor 520 may relatively increase.

A portion of the oil discharged from the first compressor 520 may flow into the distribution return passage 920. In detail, when the first valve 922 is opened, at least a portion of the oil in the first return passage 940 may be introduced from the branch point 930 to the distribution return passage 920 and be supplied to the main suction passage 700 via the first valve 922.

The oil supplied into the main suction passage 700 may be divided and collected into the first and second compressors 520 and 540. That is, at least a portion of the oil in the main suction passage 700 may be collected into the first compressor 520 through the first suction passage 820, and a remaining portion of the oil may be collected into the second compressor 540 through the second suction passage 840.

Figure 4:
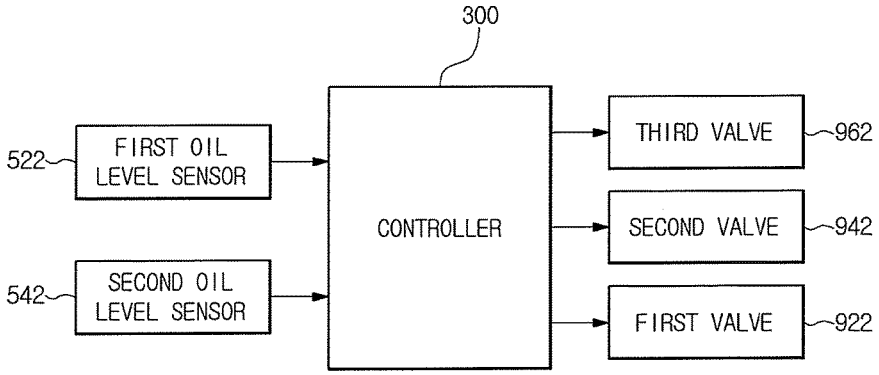
FIG. 4 is a block diagram of components for controlling oil balancing in an air conditioner according to an embodiment.

FIG. 4 is a block diagram of components for controlling oil balancing in an air conditioner according to an embodiment. Referring to FIG. 4, the air conditioner 50 according to an embodiment may further include a first oil level sensor 522 to detect an amount of oil in the first compressor 520, and a second oil level sensor 542 to detect an amount of oil in the second compressor 540. The first oil level sensor 522 may be disposed at a preset or predetermined height in the first compressor 520. The second oil level sensor 542 may be disposed at a preset or predetermined height in the second compressor 540. Each of the predetermined heights may be understood as a height that is defined when a reference amount of oil is stored.

The first oil level sensor 522 may detect the amount of oil in the first compressor 520 by determining whether a height of a surface of the oil stored in the first compressor 520 is lower than a first reference oil surface. The first oil level sensor 522 may be disposed at a position corresponding to a height of the first reference oil surface.

The second oil level sensor 542 may detect the amount of oil in the second compressor 540 by determining whether a height of the oil surface of the oil stored in the second compressor 540 is lower than a second reference oil surface. The second oil level sensor 542 may be disposed at a position corresponding to a height of the second reference oil surface.

Information detected by the first oil level sensor 522 or the second oil level sensor 542 may be transmitted to a controller 300. When the controller 300 receives the detected information from the first and second oil level sensors 522 and 542, the controller 300 may control the first to third valves 922, 942, and 962 according to the received information. The controller 300 may actively control a flow path of the collected oil and effectively achieve oil balancing by the above-described control.

Figure 5:
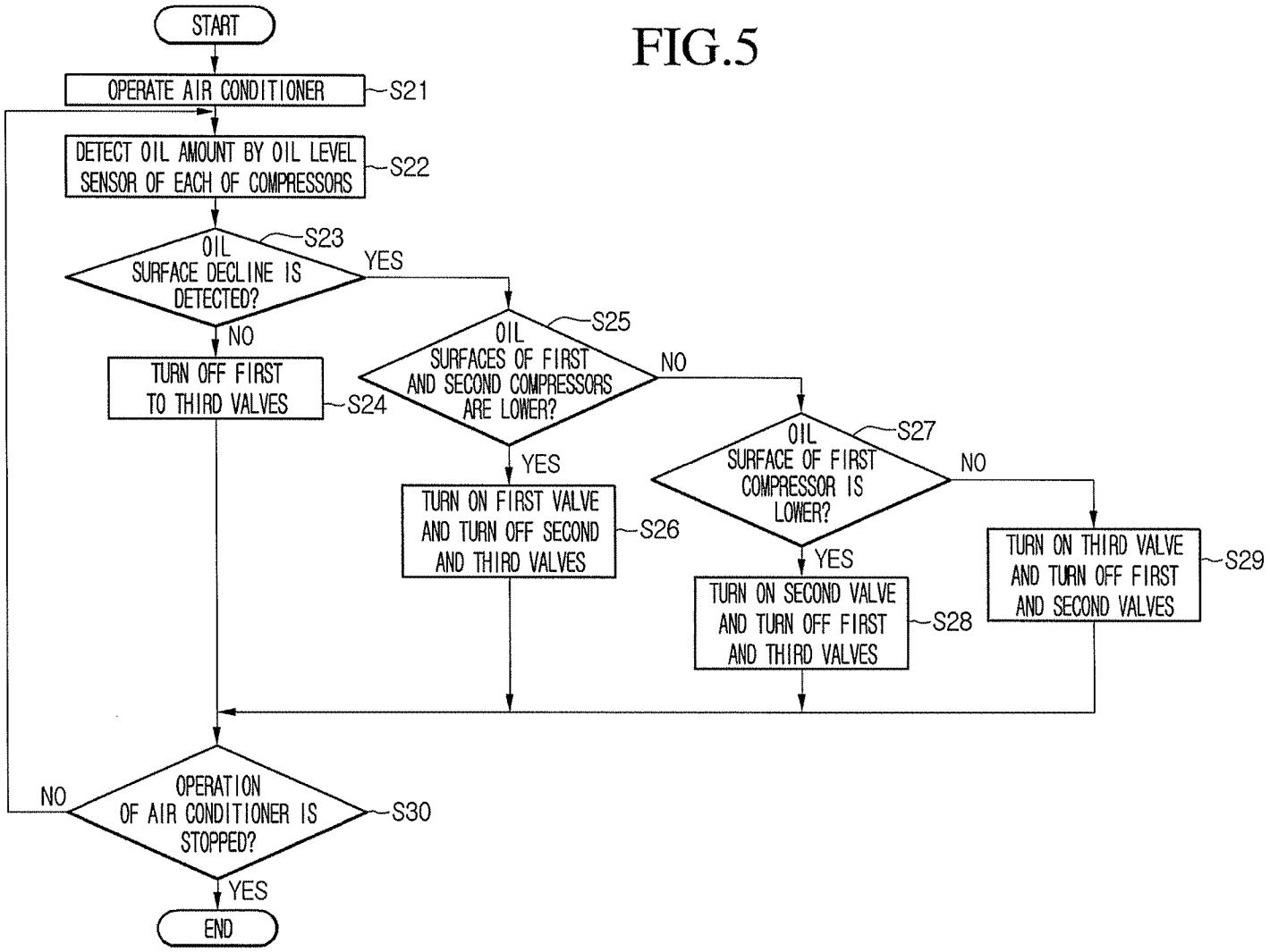
FIG. 5 is a flowchart of a method for controlling oil balancing in an air conditioner according to an embodiment.

FIG. 5 is a flowchart of a method for controlling oil balancing in an air conditioner according to an embodiment. FIGS. 6 to 9 are views illustrating an oil collection path depending on a method for controlling oil balancing in an air conditioner according to an embodiment.

Referring to FIG. 5, when an operation of the air conditioner 50 starts, in step S21, refrigerant may be compressed in the first and second compressors 520 and 540. Then, in step S22, the first oil level sensor 522 and the second oil level sensor 542 may detect an amount of oil in the first and second compressors 520 and 540, respectively.

In step S23, the controller 300 may determine whether an oil surface in the first compressor 520 or the second compressor 540 is lower or has declined, that is, whether a height of the oil surface in each of the first and second compressors 520 and 540 is lower than the reference oil surface, according to the amount of oil detected by each of the first and second oil level sensors 522 and 542. When the controller 300 determines that the oil surfaces are not lower or have not declined, amounts of oil passing through the first valve 922 in the distribution return passage 920, the second valve 942 in the first return passage 940, and the third valve 962 in the third return passage 960 may be reduced, in step S24.

For example, when each of the first to third valves 922, 942, and 962 is a solenoid valve, the first to third valves 922, 942, and 962 may be turned off or closed, in step S24. In step S24, when each of the first to third valves 922, 942, and 962 is an electronic expansion valve, each of the first to third valves 922, 942, and 962 may be reduced in opening degree.

Figure 6:
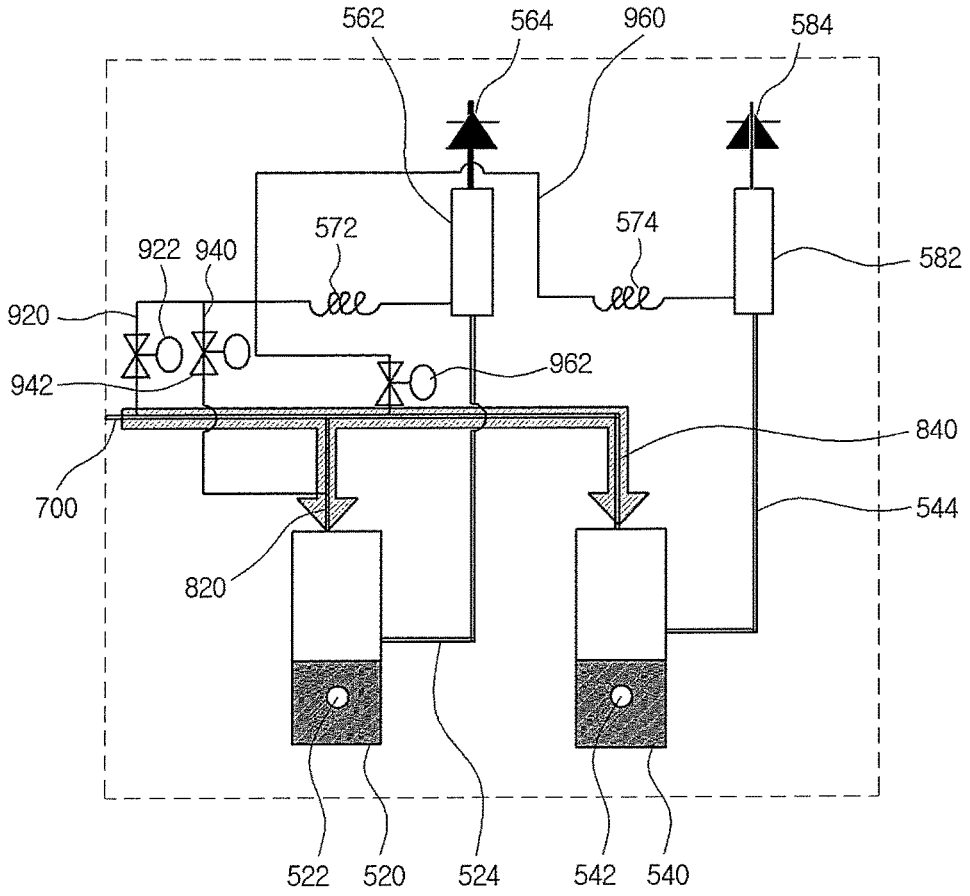
FIGS. 6 to 9 are views illustrating an oil collection path depending on a method for controlling oil balancing in an air conditioner according to an embodiment.

FIG. 6 illustrates a state in which each of the first to third valves 922, 942, and 962 is turned off or closed, or reduced in opening degree. In the control state illustrated in FIG. 6, a refrigerant passing through the gas-liquid separator 800 may flow through the main suction passage 700 and be branched into the first and second suction passages 820 and 840, and then, the branched refrigerants may be respectively, suctioned into the first and second compressors 520 and 540.

The oil separated from the first and second oil separators 562 and 582 may not be collected into the first and second compressors 540, respectively. Also, the amounts of oil in the first and second compressors 520 and 540 may be uniformly maintained.

When it is determined that the oil surface in each of the first and second compressors 520 and 540 is lower than the reference oil surface, in step S23, the amount of oil passing through the first valve 922 may be increased, and the amount of oil passing through the second and third valves 942 and 962 may be reduced, in step S25. For example, when each of the first to third valves 922, 942, and 962 is a solenoid valve, the first valve 922 may be turned on or opened, and the second and third valves 942 and 962 may be turned off or closed, in step S26. In step S26, when each of the first to third valves 922, 942, and 962 is an electronic expansion valve, the first valve 922 may be increased in opening degree, and each of the second and third valves 942 and 962 may be reduced in opening degree.

Figure 7:
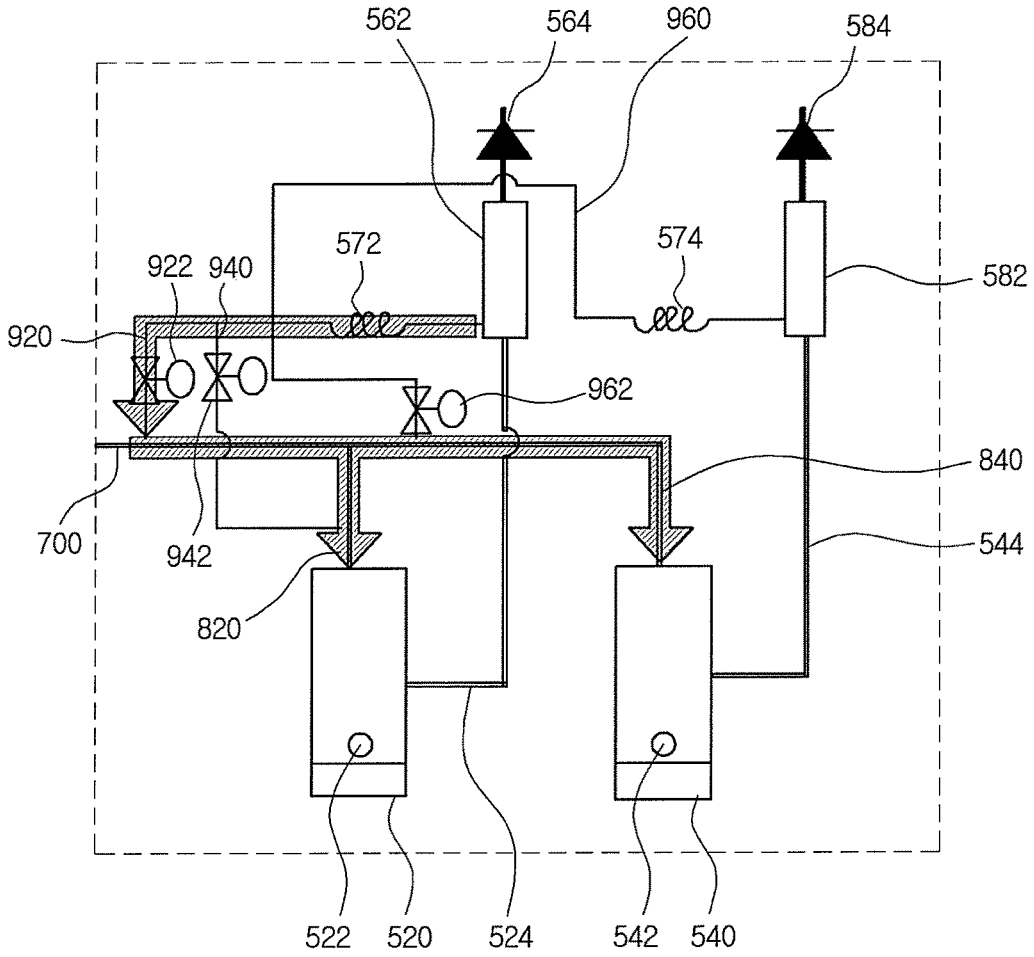

FIG. 7 illustrates a state in which the first valve 922 is turned on or opened, and the second and third valves 942 and 962 are turned off or closed. In the control state illustrated in FIG. 7, the refrigerant passing through the gas-liquid separator 800 may flow through the main suction passage 700 and be branched into the first and second suction passages 820 and 840, and then, the branched refrigerants may, respectively, flow into the first and second compressors 520 and 540.

The oil separated from the first oil separator 562 may be introduced into the main suction passage 700 via the first return passage 940 and the distribution return passage 920 and be branched into the first and second suction passages 820 and 840, and then the branched oil may be collected into the first and second compressors 520 and 540. That is, the oil collected from the first oil separator 562 together with the refrigerant may be branched and flow into the first and second compressors 520 and 540.

When it is determined that the oil surface in the first compressor 520 is lower than the reference oil surface, and the oil surface in the second compressor 540 is higher than the reference oil surface, that is, the oil surface in the second compressor 540 is maintained at a normal oil surface level, the amount of oil passing through the first valve 922 and the third valve 962 may be reduced, and the amount of oil passing through the second valve 942 may be increased, in step S27. For example, when each of the first to third valves 942, 942, and 962 is a solenoid valve, the second valve 942 may be turned on or opened, and the first and third valves 922 and 962 may be turned off or closed, in steps S28. In step S28, when each of the first to third valves 942, 942, and 962 is an electronic expansion valve, the second valve 942 may be increased in opening degree, and each of the first and third valves 922 and 962 may be reduced in opening degree.

Figure 8:
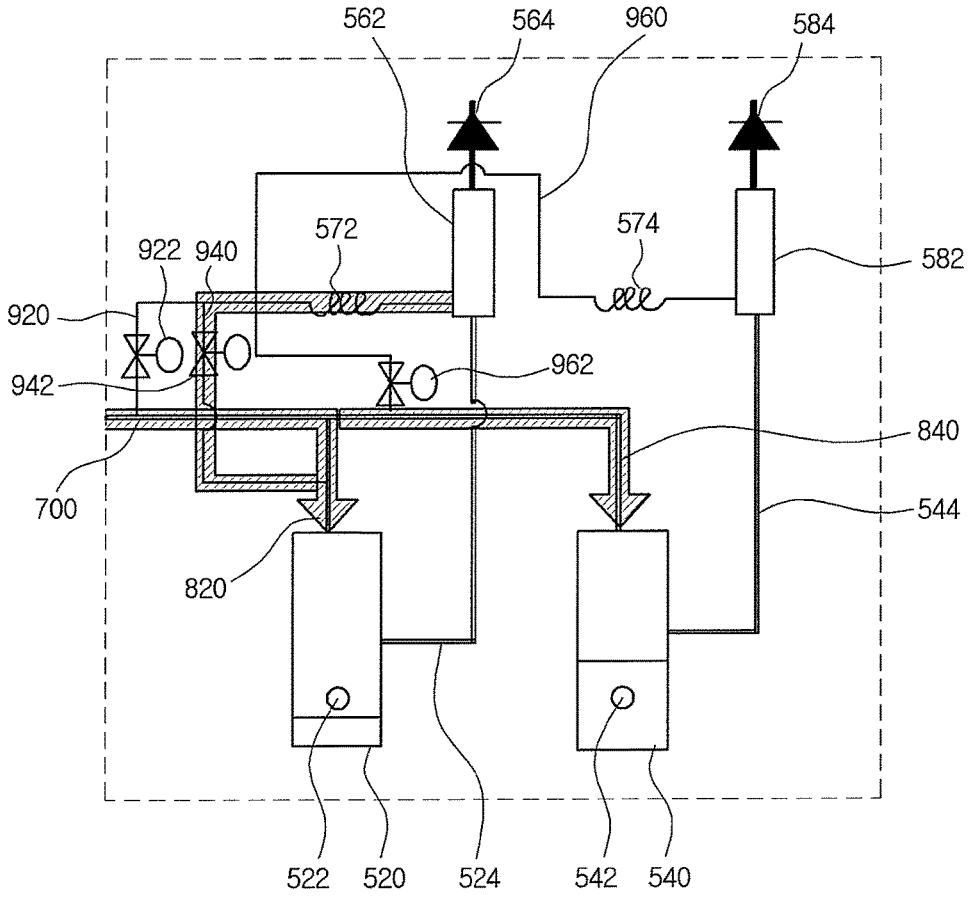

FIG. 8 illustrates a state in which the second valve 942 is turned on or opened, and the first and third valves 922 and 962 are turned off or closed. In the control state illustrated in FIG. 8, the refrigerant passing through the gas-liquid separator 800 may flow through the main suction passage 700 and be branched into the first and second suction passages 820 and 840, and then, the branched refrigerants may, respectively, flow into the first and second compressors 520 and 540. Also, the oil separated from the first oil separator 562 may be introduced into the first suction passage 820 via the first return passage 940, and then, may be collected into the first compressor 520.

When it is determined that the oil surface in the first compressor 520 is higher than the reference oil surface, that is, the oil surface in the first compressor 520 is maintained at the normal oil surface level, and the oil surface in the second compressor 540 is lower than the reference oil surface, the amount of oil passing through the first valve 922 and the second valve 942 may be reduced, and the amount of oil passing through the third valve 962 may be increased, in step S29.

For example, when each of the first to third valves 962, 942, and 962 is a solenoid valve, the third valve 962 may be turned on or opened, and the first and second valves 922 and 942 may be turned off or closed, in step S29. In step S29, when each of the first to third valves 962, 942, and 962 is an electronic expansion valve, the third valve 962 may be increased in opening degree, and each of the first and second valves 922 and 942 may be reduced in opening degree.

Figure 9:
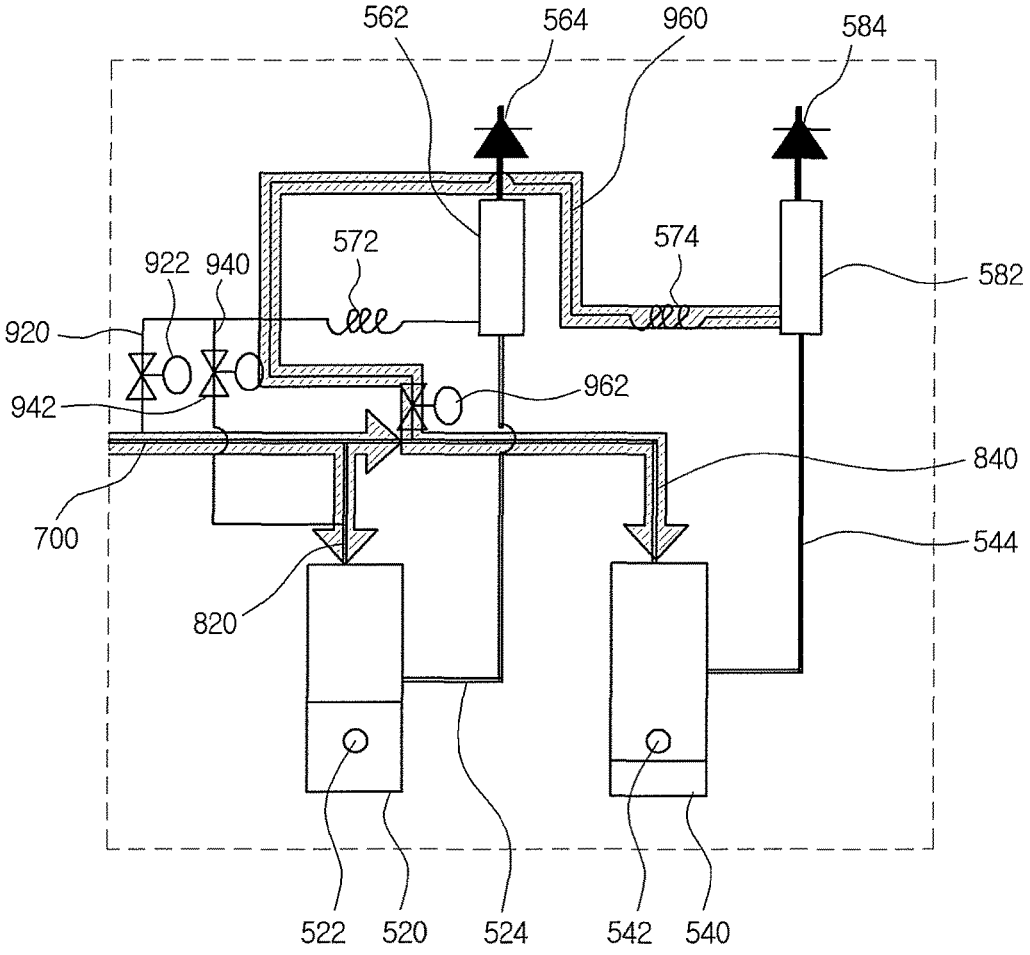

FIG. 9 illustrates a state in which the third valve 962 is turned on or opened, and the first and second valves 922 and 942 are turned off or closed. In the control state illustrated in FIG. 9, the refrigerant passing through the gas-liquid separator 800 may flow through the main suction passage 700 and be branched into the first and second suction passages 820 and 840, and then, the branched refrigerants may, respectively, flow into the first and second compressors 520 and 540. Also, the oil separated from the second oil separator 582 may be introduced into the second suction passage 840 via the second return passage 960, and then, may be collected into the second compressor 540.

In step S30, the above-described controlling method may be repeatedly performed until the air conditioner 50 is stopped.

According to the method according to embodiments disclosed herein, when it is determined that the first and second compressors 520 and 540 lacks oil, the plurality of valves may be controlled to immediately collect the oil through the distribution passage 920 or the first and second return passages 940 and 960.

According to embodiments disclosed herein, as the plurality of return passages to collect the oil from the oil separator into the plurality of compressors may be connected to each other, and the plurality of return passages may be actively and selectively opened according to the oil balance information detected by the oil level sensors, oil balancing may be more quickly performed.

Therefore, as oil balancing of the plurality of compressors may be effectively maintained, the compressor may be improved in operation reliability.

Embodiments disclosed herein provide an air conditioner that detects an oil balance between a plurality of compressors to vary an oil return passage according to the detected result, thereby more actively and quickly controlling an oil balance and a method for controlling an air conditioner.

Embodiments disclosed herein provide an air conditioner that may include a compressor; a main suction passage to guide suction of a refrigerant into the compressor; an oil separator connected to the compressor, that separates oil from the refrigerant discharged from the compressor; an oil level sensor disposed in the compressor to detect whether the compressor lacks oil; a return passage to collect the oil separated from the oil separator into the compressor; a distribution return passage branched from the return passage and connected to the main suction passage; and a valve disposed in each of the return passage and the distribution return passage.

The compressor may include a first compressor, and a second compressor. The oil separator may include a first oil separator disposed at an outlet-side of the first compressor, and a second oil separator disposed at an outlet-side of the second compressor. The return passage may include a first return passage that extends from the first oil separator toward a suction-side of the first compressor, and a second return passage that extends from the second oil separator toward a suction-side of the second compressor.

The air conditioner may further include a first suction passage branched from the main suction passage to the first compressor and connected to the first return passage, and a second suction passage branched from the main suction passage to the second compressor and connected to the second return passage. The first return passage may include a branch part or point at which the distribution return passage is branched. The distribution return passage may extend from the branch part to the main suction passage.

The first compressor may be a main compressor, and the second compressor may be a sub compressor.

The valves may include a first valve disposed in the distribution return passage, a second valve disposed in the first return passage, and a third valve disposed in the third return passage.

The air conditioner may further include a control unit or controller to control an operation of the first valve, the second valve, or the third valve according to a lack of oil in the first compressor or the second compressor. When the control unit determines that the first and second compressors lack oil, the control unit may increase an amount of oil passing through the first valve and decrease an amount of oil passing through the second and third valves. When the control unit determines that the first compressor lacks oil, and the second compressor does not lack oil, the control unit may decrease an amount of oil passing through the first and third valves and increase an amount of oil passing through the second valve.

The oil level sensor may include a first oil level sensor disposed at a set or predetermined height of the first compressor, and a second oil level sensor disposed at a set or predetermined height of the second compressor. The valve may include a solenoid valve or an electronic expansion valve.

Embodiments disclosed herein further provide a method for controlling an air conditioner including first and second oil separators, respectively, connected to first and second compressors to separate oil from refrigerants discharged from the first and second compressors. The method may include detecting an amount of oil in each of the first and second compressors by using an oil level sensor disposed in each of the first and second compressor, and selectively opening a plurality of return passages to collect the oil from the first oil separator or the second oil separator according to the detected oil amount. The plurality of return passages may include a first return passage to collect the oil from the first oil separator into the first compressor, a second return passage to collect the oil from the oil separator into the second compressor, and a distribution return passage that extends from the first return passage to the main suction passage of the first and second compressors.

The method may further include a first valve disposed in the distribution return passage, a second valve disposed in the first return passage, and a third return passage disposed in the third return passage. When an amount of oil in each of the first and second compressors is less than a reference amount, the method may include turning off or closing the second and third valves, and turning on or opening the first valve. When one of the first and second compressors has an oil amount less than the reference amount, the method may include turning off or closing the first valve, and turning on or opening one of the second and third valves.

Embodiments disclosed herein further provide an air conditioner that may include a first compressor including a first oil level sensor; a first oil separator to separate oil from a refrigerant discharged from the first compressor; a second compressor including a second oil level sensor; a second oil separator to separate oil from a refrigerant discharged from the second compressor; a main suction passage disposed at suction-sides of the first and second compressors; a first suction passage branched from the main suction passage to extend to the first compressor; a second suction passage branched from the main suction passage to extend to the second compressor; a first return passage that extends from the first oil separator to the first suction passage; a distribution return passage branched from the first return passage to extend to the main suction passage; and a second return passage that extends from the second oil separator to the second suction passage. The first return passage, the second return passage, or the distribution return passage may be selectively opened according to an amount of oil detected by the first or second oil level sensor.

The air conditioner may further include a first valve disposed in the distribution return passage. The air conditioner may further include a second valve disposed in the first return passage, and a third valve disposed in the second return passage. When the amount of oil detected by each of the first and second oil level sensors is less than a reference amount, the first valve may be opened, and the second and third valves may be closed. The air conditioner may further include a first capillary tube disposed in the first return passage, and a second capillary tube disposed in the second return passage.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air conditioner, comprising:

a main suction passage to guide a refrigerant into a first compressor and a second compressor;

a first oil separator connected to the first compressor, that separates oil from the refrigerant discharged from the first compressor;

a second oil separator connected to the second compressor, that separates oil, from the refrigerant discharged from the second compressor;

at least one oil level sensor disposed at the first compressor and the second compressor to detect whether at least one of the first compressor or the second compressor lacks oil;

a first suction passage branched from the main suction passage to the first compressor;

a second suction passage branched from the main suction passage to the second compressor;

a first return passage that extends from the first oil separator to the first suction passage, the first return passage being connected to a suction-side of the first compressor;

a second return passage that extends from the second oil separator to the second suction passage, the second return passage being connected to a suction-side of the second compressor;

a distribution return passage extending from a branch point of the first return passage to the main suction passage;

a first valve disposed in the distribution return passage;

a second valve disposed in first return passage;

a third valve disposed in the second return passage; and a controller that controls an operation of the first valve, the second valve, or the third valve, based on the lack of the oil in the first compressor or the second compressor, wherein the controller is configured to open the first valve and close the second and third valves so that the first compressor and the second compressor receive oil discharged from only the first oil separator.

2. The air conditioner according to claim 1, wherein the first oil separator is disposed at an outlet-side of the first compressor; and the second oil separator is disposed at an outlet-side of the second compressor.

3. The air conditioner according to claim 1, wherein the first compressor is a main comp and the second compressor is a sub compressor.

4. The air conditioner according to claim 1, wherein, when the first compressor operates before the second compressor, the controller is configured to open the first valve and close the second and third valves so that the first compressor and the second compressor receive oil discharged from only the first oil separator.

5. The air conditioner according to claim 1, wherein, when the first compressor and the second compressor lack oil, the controller is configured to open the first valve and close the second and third valves so that the first compressor and the second compressor receive oil discharged from only the first oil separator.

6. The air conditioner according to claim 1, wherein the at least one oil level sensor comprises:

a first oil level sensor disposed at a predetermined height in the first compressor; and a second oil level sensor disposed at a predetermined height in the second compressor.

7. The air conditioner according to claim 1, wherein each of the first valve and the second valve comprises a solenoid valve or an electronic expansion valve.

8. The air conditioner according to claim 1, further comprising:

a first capillary tube disposed in the first return passage; and a second capillary tube disposed in the second return passage.

9. The air conditioner according to claim 1, further comprising:

a first refrigerant discharge passage provided at an outlet-side of the first oil separator; and a second refrigerant discharge passage provided at an outlet-side of the second oil separator.

10. The air conditioner according to claim 9, further comprising:

a first check valve provided in the first refrigerant discharge passage that prevents the refrigerant from being re-introduced into the first oil separator; and a second check valve, provided in the second refrigerant discharge passage that prevents the refrigerant from being re-introduced into the second oil separator.

11. A method for controlling an air conditioner comprising first and second oil separators that are, respectively, connected to first and second compressors to separate oil from refrigerant discharged from the first and second compressors, a main suction, passage to guide the refrigerant into the first and second compressors, a first suction passage branched from the main suction passage to the first compressor, and a second suction passage branched from the main suction passage to the second compressor, the method comprising:

detecting an amount of oil in each of the first and second, compressors using an oil level sensor disposed in each of the first and second compressors;

selectively opening a plurality of return passages to return the oil from the first oil separator or the second oil separator according to the detected oil amount; and receiving oil discharged from only the first oil separator into the first compressor and the second compressor when the amount of oil of the first compressor and the second compressor is less than a reference amount or when the first compressor operates before the second compressor, wherein the plurality of return passages comprises:

a first return passage to return the oil from the first oil separator into the first compressor, the first return passage being extended to the first suction passage;

a second return passage to return the oil from the second oil separator into the second compressor, the second return passage being extended to the second suction passage; and a distribution return passage that extends from the first return passage to a main suction passage of the first and second compressors.

12. The method according to claim 11, wherein the air conditioner further comprises:

a first valve disposed in the distribution return passage;

a second valve disposed in the first return passage; and a third return passage disposed in the second return passage, and wherein the method further comprises, when the amount of oil in each of the first and second compressors is less than a reference amount, turning off or closing the second and third valves, and turning on or opening the first valve.

13. The method according to claim 12, wherein the method further comprises, when one of the first compressor or the second compressor has an oil amount less than the reference amount, turning off or closing the first valve, and turning on one of the second valve or the third valve.

* * * * *